US008170436B2

(12) United States Patent
Barton et al.

(10) Patent No.: US 8,170,436 B2
(45) Date of Patent: May 1, 2012

(54) APPARATUSES USEFUL FOR PRINTING AND METHODS OF CONTROLLING A TEMPERATURE OF A SURFACE IN APPARATUSES USEFUL FOR PRINTING

(75) Inventors: Augusto E. Barton, Webster, NY (US); Faming Li, Penfield, NY (US); Anthony S. Condello, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 494 days.

(21) Appl. No.: 12/352,209

(22) Filed: Jan. 12, 2009

(65) Prior Publication Data

US 2010/0178071 A1 Jul. 15, 2010

(51) Int. Cl.
*G03G 15/20* (2006.01)

(52) U.S. Cl. ..... 399/69; 399/33; 399/329; 399/331; 219/216

(58) Field of Classification Search ..... 399/9, 33, 399/38, 67, 69, 122, 320, 328–331, 335, 399/338; 219/216, 244
See application file for complete search history.

(56) References Cited

U.S. PATENT DOCUMENTS

2004/0022550 A1* 2/2004 Okada ..... 399/67
2007/0092277 A1* 4/2007 Miyata et al. ..... 399/69
2008/0037069 A1 2/2008 Mestha et al.

OTHER PUBLICATIONS

Staco Energy Products Co.; http://www.stacoenergy.com/contact_us.htm; Jan. 12, 2009.
Staco Energy Products Co.; http://www.alliedelec.com/catalog/catalogpages/200708/973.pdf; Ganged Variable Transformers, Controllers and Replacement Parts; p. 973.
Electronic Specialists, Inc. http://www.elect-spec.com/variac_a.htm; Precision Variable Transformer Voltage Regulators; Jan. 12, 2009.

* cited by examiner

*Primary Examiner* — David Porta
*Assistant Examiner* — Benjamin Schmitt
(74) *Attorney, Agent, or Firm* — Ronald E. Prass, Jr.; Prass LLP

(57) ABSTRACT

Apparatuses useful for printing and methods of controlling a temperature of a surface in an apparatus useful for printing are disclosed. An exemplary embodiment of the apparatuses includes a first roll including a first outer surface and at least one first heating element for heating the first outer surface; a second roll including a second outer surface; a nip between the first outer surface and the second outer surface; a first temperature sensor for sensing a pre-nip temperature at a pre-nip location; and a first voltage modulator connected to each first heating element and the first temperature sensor. The first voltage modulator receives a temperature signal from the first temperature sensor indicative of the pre-nip temperature and modulates an AC voltage supplied to each first heating element to maintain each first heating element continuously ON at a power level ranging from partial power to full power to control the pre-nip temperature.

3 Claims, 5 Drawing Sheets

APPARATUSES USEFUL FOR PRINTING AND METHODS OF CONTROLLING A TEMPERATURE OF A SURFACE IN APPARATUSES USEFUL FOR PRINTING

BACKGROUND

In some printing apparatuses, images are formed on media, such as paper, using a marking material. Such printing apparatuses can include opposed members that form a nip between them. Media are fed to the nip where the members apply pressure and supply thermal energy to the media.

It would be desirable to provide apparatuses and methods that can be used to form prints with control of the heat source to improve user comfort.

SUMMARY

Apparatuses useful for printing and methods for controlling a temperature of a surface in apparatuses useful for printing are disclosed. An exemplary embodiment of the apparatuses comprises a first roll including a first outer surface and at least one first heating element for heating the first outer surface; a second roll including a second outer surface; a nip between the first outer surface and the second outer surface; a first temperature sensor for sensing a pre-nip temperature at a pre-nip location; and a first voltage modulator connected to each first heating element and the first temperature sensor. The first voltage modulator receives a temperature signal from the first temperature sensor indicative of the pre-nip temperature and modulates an AC voltage supplied to each first heating element to maintain each first heating element continuously ON at a power level ranging from partial power to full power to control the pre-nip temperature.

DRAWINGS

DETAILED DESCRIPTION

Figure 1:
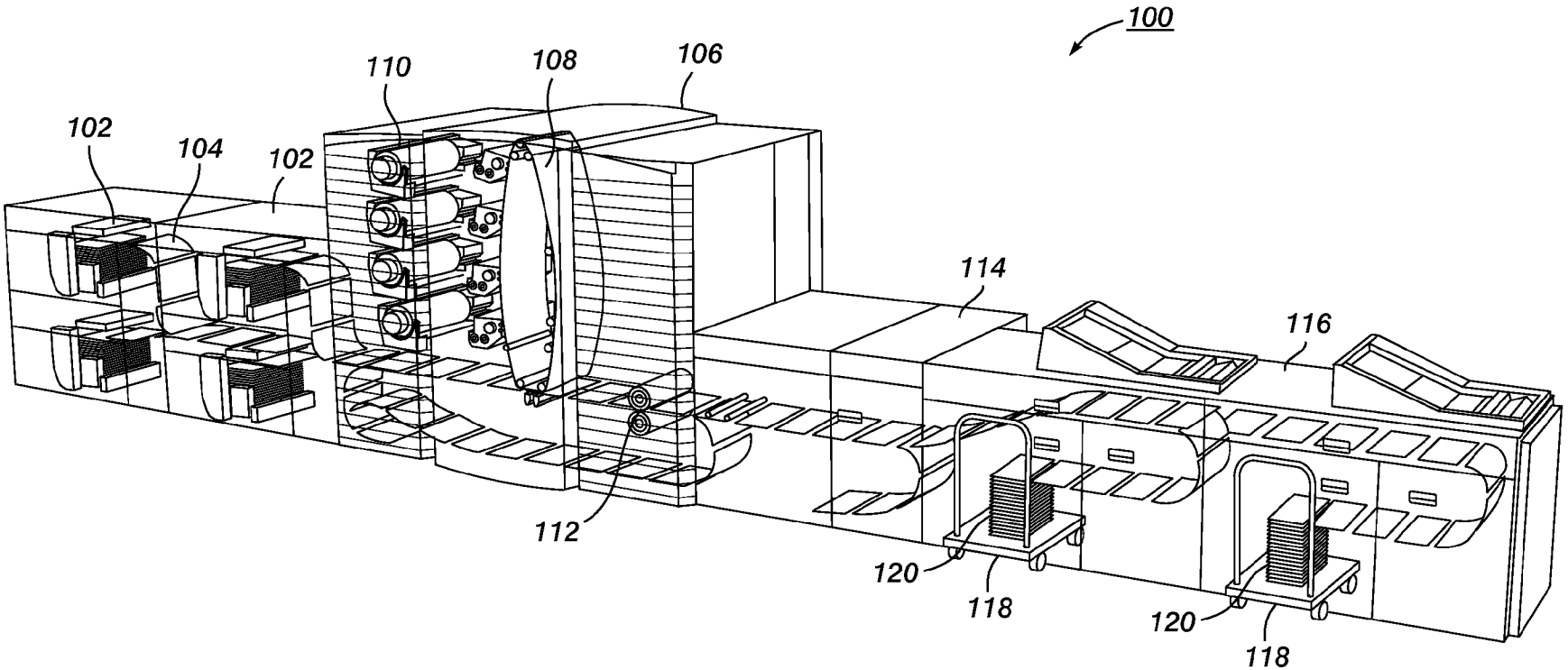
FIG. 1 illustrates an exemplary embodiment of a printing apparatus.

The disclosed embodiments include an apparatus useful for printing, which comprises a first roll including a first outer surface and at least one first heating element for heating the first outer surface; a second roll including a second outer surface; a nip between the first outer surface and the second outer surface; a first temperature sensor for sensing a pre-nip temperature at a pre-nip location; and a first voltage modulator connected to each first heating element and the first temperature sensor. The first voltage modulator receives a temperature signal from the first temperature sensor indicative of the pre-nip temperature and modulates an AC voltage supplied to each first heating element to maintain each first heating element continuously ON at a power level ranging from partial power to full power to control the pre-nip temperature.

The disclosed embodiments further include an apparatus useful for printing, which comprises a first roll including a first outer surface; a second roll including a second outer surface; a continuous belt between the first outer surface and the second outer surface, the belt including an inner surface contacting the first outer surface and an outer surface contacting the second outer surface to form a nip; a third roll including a third outer surface contacting the belt and at least one first heating element for heating the third outer surface; a first temperature sensor for sensing a pre-nip temperature at a pre-nip location on the outer surface of the belt; and a first voltage modulator connected to each first heating element and the first temperature sensor. The first voltage modulator receives a temperature signal from the first temperature sensor indicative of the pre-nip temperature and modulates an AC voltage supplied to each first heating element to maintain each first heating element continuously ON at a power level ranging from partial power to full power to control the pre-nip temperature.

The disclosed embodiments further include a method for controlling a temperature of a surface in an apparatus useful for printing. The apparatus comprises a first roll including a first outer surface, a second roll including a second outer surface, a nip between the first outer surface and the second outer surface, and a third roll including a third outer surface. The method comprises heating at least one of the first outer surface and the third outer surface with at least one heating element; sensing a pre-nip temperature at a pre-nip location; and modulating an AC voltage supplied to each heating element to maintain each heating element continuously ON at a power level ranging from partial power to full power to control the pre-nip temperature.

As used herein, the term "printing apparatus" encompasses any apparatus, such as a digital copier, bookmaking machine, multifunction machine, and the like, that performs a print outputting function for any purpose. Such printing apparatuses can use various types of solid and liquid marking materials, such as toner and inks including liquid inks, gel inks, heat-curable inks and radiation-curable inks, and the like. Such printing apparatuses can use various thermal, pressure and other conditions to form images on media with the marking materials.

FIG. 1 illustrates an exemplary printing apparatus 100, such as disclosed in U.S. Patent Application Publication No. 2008/0037069, which is incorporated herein by reference in its entirety. The printing apparatus 100 can be used to produce prints from media at high speeds. The printing apparatus 100 includes two media feeder modules 102 arranged in series, a printer module 106 adjacent the media feeding modules 102, an inverter module 114 adjacent the printer module 106, and two stacker modules 116 arranged in series adjacent the inverter module 114.

In the printing apparatus 100, the media feeder modules 102 feed media to the printer module 106. In the printer module 106, marking material (e.g., containing toner) is transferred from a series of developer stations 110 to a charged photoreceptor belt 108 to form toner images on the photoreceptor belt 108 and produce color prints. The toner images are transferred to media 104 transported through the paper path. The media are advanced through a fuser 112 including a fuser roll 113 and pressure roll 115 to fuse the toner images on the media. The inverter module 114 manipulates media exiting the printer module 106 by either passing the media through to the stacker modules 116, or inverting and returning the media to the printer module 106. In the stacker modules 116, the printed media are loaded onto stacker carts 118 to form stacks 120.

Apparatuses useful for printing are provided. Embodiments of the apparatuses are constructed to supply thermal energy and pressure to media having marking material on them. Different types of media can be used. Embodiments of the apparatuses include a heated member for supplying thermal energy to media. In embodiments, the member operates at a stable output temperature. In some embodiments, the member is a heated belt supported by two or more rolls. The belt contacts media to treat marking material on the media. In other embodiments, the heated member is a roll used to treat marking material on media. Embodiments of the apparatuses are constructed to reduce line voltage flicker.

Figure 2:
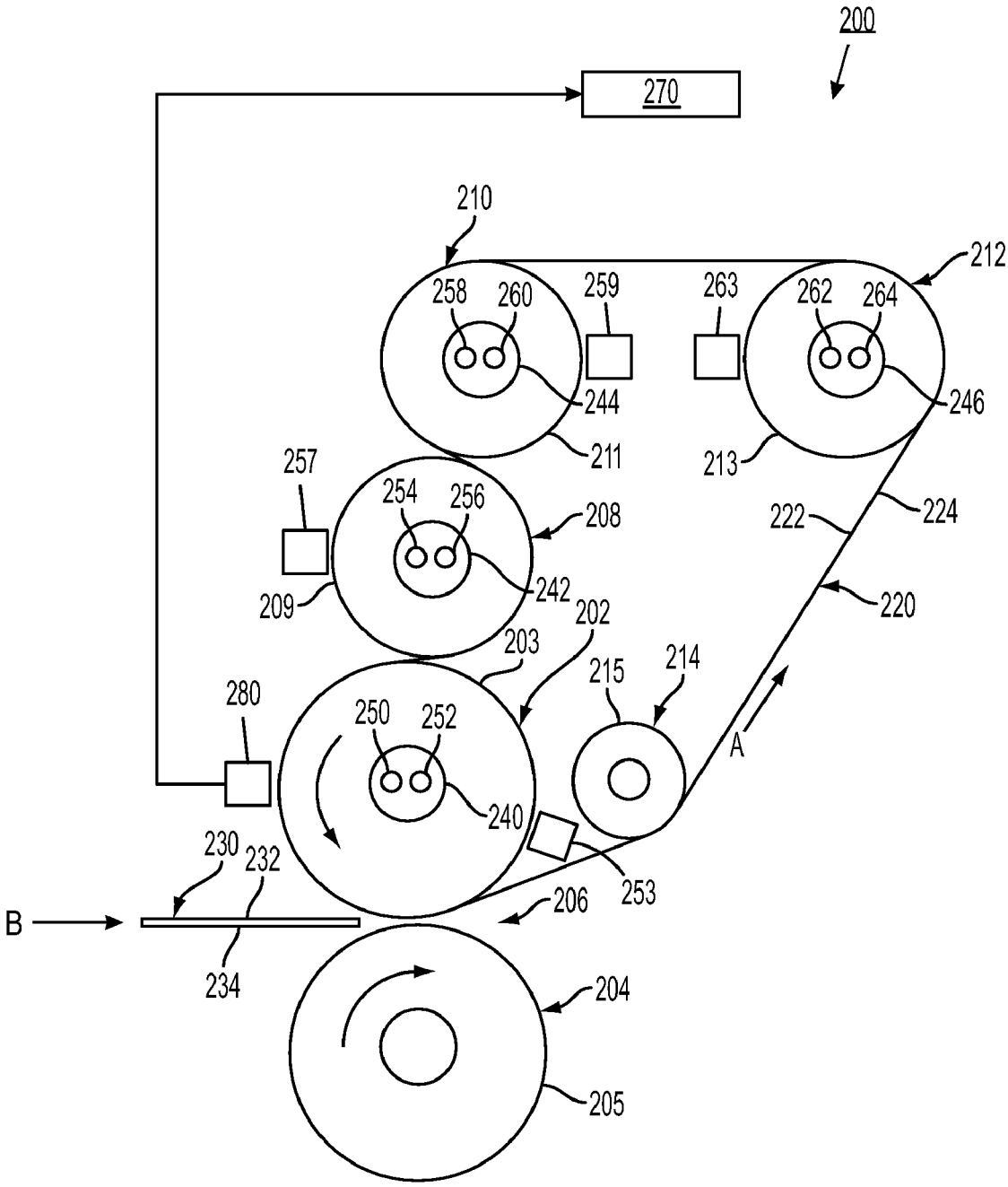
FIG. 2 illustrates an exemplary embodiment of a fuser including a heated belt.

FIG. 2 illustrates an exemplary embodiment of the apparatuses useful for printing. The illustrated apparatus is a fuser 200. Embodiments of the fuser 200 can be used with different types of apparatuses that provide a print output function. For example, the fuser 200 can be used in place of the fuser 112 in the printing apparatus 100 shown in FIG. 1.

The illustrated embodiment of the fuser 200 includes an endless (continuous) belt 220 supported by a fuser roll 202, external roll 208, internal rolls 210, 212 and an idler roll 214. The belt 220 includes an inner surface 222 and an outer surface 224. Other embodiments of the fuser 200 can include less than four rolls (e.g., two), or more than four rolls. At least one roll, or each roll, of the fuser 200 can be heated.

The fuser roll 202, external roll 208, internal rolls 210, 212 and idler roll 214 include outer surfaces 203, 209, 211, 213, 215, respectively, which contact the belt 220. The belt 220 is actively heated by the heated rolls. In the illustrated embodiment, the fuser roll 202 includes heating elements 250, 252; the external roll 208 includes heating elements 254, 256; the internal roll 210 includes heating elements 258, 260; and the internal roll 212 includes heating elements 262, 264. In other embodiments, the fuser roll 202 may not include heating elements to actively heat the outer surface 203.

In embodiments, the heating elements 250, 252, 254, 256, 258, 260, 262, 264 are axially-extending lamps, such as tungsten-quartz lamps, located inside of the rolls. In embodiments, the heating elements 250, 254, 258 and 262 can have the same length and power rating as each other, and the heating elements 252, 256, 260 and 264 can have the same length and power rating as each other. For example, the heating elements 250, 254, 258 and 262 can each be long, and the heating elements 252, 256, 260 and 264 can each be short. In other embodiments, the fuser roll 202, external roll 208 and internal rolls 210, 212 can each include, e.g., a single heating element, or more than two heating elements. The heating elements 250, 252, 254, 256, 258, 260, 262 and 264 can have a rated power of about 1000 watts, for example.

The fuser 200 further includes an external pressure roll 204 having an outer surface 205. The outer surface 205 and the outer surface 224 of the belt 220 form a nip 206. In embodiments, the pressure roll 204 can include an outer layer having the outer surface 205 overlying a core. In embodiments, the core can be comprised of aluminum or the like, covered by an elastically deformable material, such as silicone; and the outer layer can be comprised of an elastically deformable material, such as perfluoroalkoxy (PFA) copolymer resin, or the like.

Embodiments of the belt 220 can include multiple layers including, e.g., a base layer, an intermediate layer on the base layer, and an outer layer on the intermediate layer. In such embodiments, the base layer forms the inner surface 222 of the belt 220, and the outer layer forms the outer surface 224 of the belt 220. In an exemplary embodiment of the belt 220, the base layer is comprised of a polymeric material, such as polyimide, or the like; the intermediate layer is comprised of silicone, or the like; and the outer layer is comprised of a polymeric material, such as a fluoroelastomer sold under the trademark Viton® by DuPont Performance Elastomers, L.L.C., polytetrafluoroethylene (Teflon®), or the like.

In embodiments, the belt 220 has a thickness of, e.g., about 0.1 mm to about 0.6 mm. For example, the base layer can have a thickness of about 50 μm to about 100 μm, the intermediate layer a thickness of about 100 μm to about 500 μm, and the outer layer a thickness of about 20 μm to about 40 μm. The belt 220 can typically have a width of about 350 mm to about 450 mm, and a length of about 500 mm to about 1000 mm, or even longer.

FIG. 2 depicts a medium 230 with opposed surfaces 232, 234 being fed to the nip 206 in the process direction B. Marking material (e.g., toner) is present on the surface 232 of the medium 230. In embodiments, the fuser roll 202 is rotated counter-clockwise and the pressure roll 204 is rotated clockwise to transport the medium 230 through the nip 206 in the process direction. The belt 220 rotates in the process direction A. The medium 230 can be a paper sheet, transparency, packaging material, or the like. Typically, paper can be classified as light-weight, medium-weight, or heavy-weight, and can be coated or uncoated. A larger amount of energy (per thickness and per basis weight) is applied to fuse marking material on coated media as compared to uncoated media.

The fuser 200 further includes a voltage modulator 270 electrically connected to the heating elements 250, 252, 254, 256, 258, 260, 262, 264 in a conventional manner. The voltage modulator 270 controls the power output of these heating elements during warm-up, standby and print runs, so as to control heating of the belt 220. In embodiments of the fuser 200 in which the fuser roll 202 does not include heating elements 250, 252, the voltage modulator 270 is connected only to the heating elements 254, 256, 258, 260, 262, 264.

The fuser 200 includes a temperature sensor 280 for sensing a pre-nip temperature at a pre-nip location. In embodiments, the temperature sensor 280 is positioned over (e.g., proximate to (as shown), or in contact with) the outer surface 224 of the belt 220 to sense the temperature of the outer surface 224 at a pre-nip location. In embodiments, pre-nip location is proximate to the inlet end of the nip 206 at which the medium 230 enters the nip 206. For example, the temperature sensor 280 can be located about 25 mm to about 50 mm from the inlet end of the nip 206. For example, the temperature sensor 280 can be located about 25 mm to about 50 mm from the inlet end of the nip 206, or the temperature sensor 280 can be located closer to, or further from, the inlet end of the nip 206. The temperature sensor 280 sends a temperature signal to the voltage modulator 270 to which the temperature sensor 280 is electrically connected. The temperature signal is indicative of the temperature of the outer surface 224.

The fuser 200 further includes devices for monitoring overheating of each of the fuser roll 202, external roll 208 and the external rolls 210 and 212. In embodiments, the fuser 200 includes a thermistor 253 facing the outer surface 203 of the fuser roll 202, a thermistor 257 facing the outer surface 209 of external roll 208, a thermistor 259 facing the outer surface 211 of internal roll 210, and a thermistor 263 facing the outer surface 213 of internal roll 212. In embodiments of the fuser 200 in which the fuser roll 202 does not include heating elements 250, 252, a thermistor is not provided for the fuser roll 202. In embodiments, the thermistors 253, 257, 259 and 263 are positioned over (e.g., proximate to (e.g., within less than about 5 mm) or in contact with) the respective outer surfaces 203, 209, 211 and 213. The thermistors 253, 257, 259, 263 provide a safety function to cause the supply of voltage to the pairs of heating elements 250, 252; 254, 256; 258, 260; 262, 264, respectively, to be stopped when the temperature of the fuser roll 202, external roll 208, internal roll 210 and/or internal roll 212 exceeds a limit temperature to avoid overheating of these rolls. For example, if the external roll 208 exceeds its limit temperature, while the fuser roll 202, internal roll 210 and internal roll 212 do not exceed their respective limit temperatures, the supply of voltage to the heating elements 254, 256 of the external roll 208 is stopped, while voltage continues to be supplied to the heating elements 250, 252; 258, 260; and 262, 264. When the external roll 208 cools to below the limit temperature, the supply of voltage to the heating elements 254, 256 is resumed.

Figure 3:
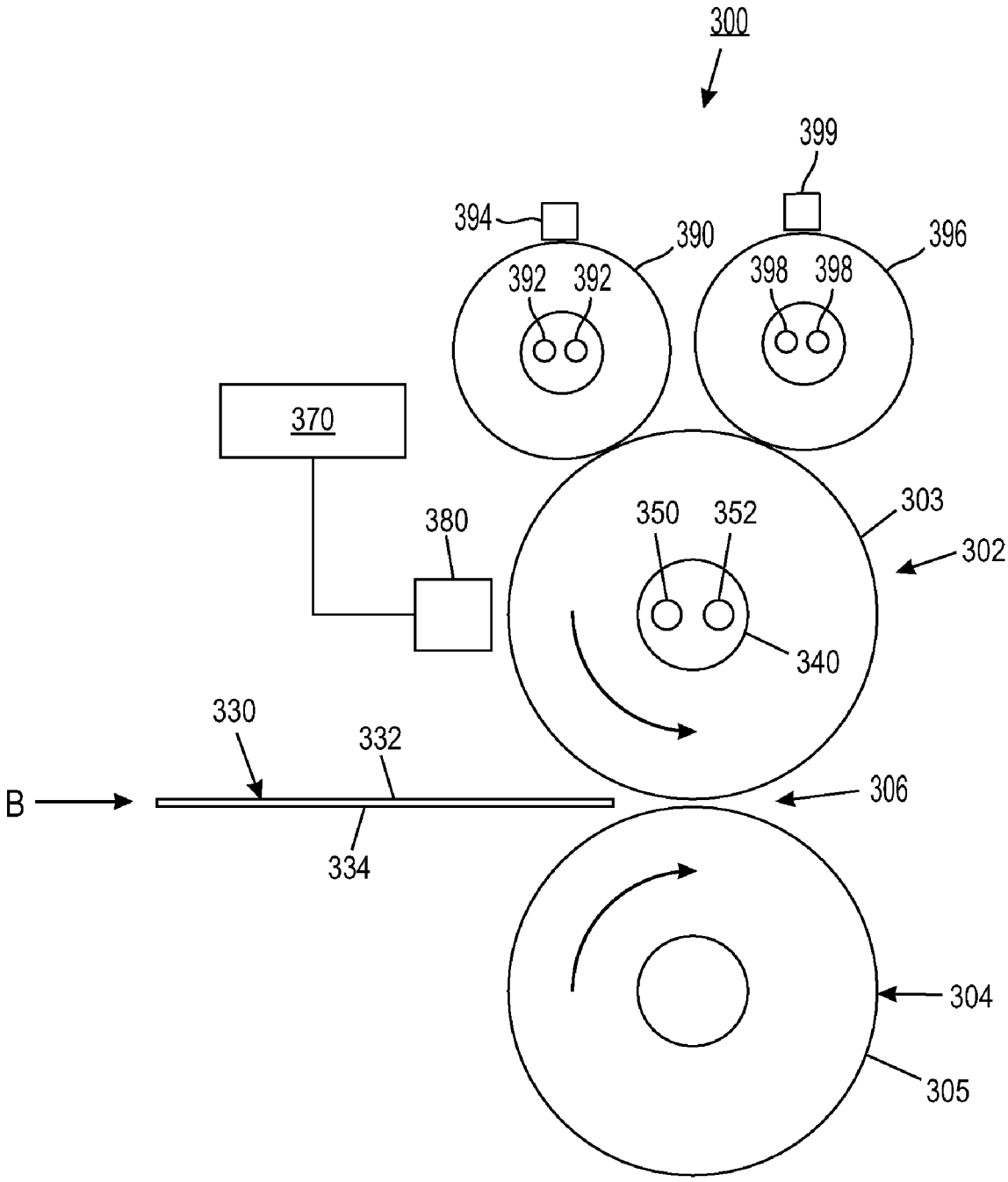
FIG. 3 illustrates an exemplary embodiment of a fuser including a fuser roll.

FIG. 3 depicts another exemplary embodiment of an apparatus useful for printing. The apparatus is a fuser 300. Embodiments of the fuser 300 can be used, e.g., in different types of apparatuses that provide a print output function. For example, the fuser 300 can be used in place of the fuser 112 in the printing apparatus 100 shown in FIG. 1.

The illustrated embodiment of the fuser 300 includes a fuser roll 302 with an outer surface 303, and a pressure roll 304 with an outer surface 305. In an exemplary embodiment, the fuser roll 302 includes a core comprised of metal, and at least one layer, which is comprised of an elastically deformable material and forms the outer surface 305, overlying the core. The pressure roll 304 can have the same construction as the pressure roll 204 of the fuser 200, for example. A nip 306 is formed by the outer surface 303 of the fuser roll 302 and the outer surface 305 of the pressure roll 304. The outer surfaces 303, 305 can be positioned in engagement with each other.

The fuser roll 302 includes internal heating elements 350, 352. The heating elements 350, 352 can be axially-extending lamps having different lengths. In other embodiments, the fuser roll 302 can include a single heating element, or more than two heating elements. The heating elements 350, 352 can have a rated power of about 1000 watts, for example.

FIG. 3 depicts a medium 330 having opposed surfaces 332, 334 being fed to the nip 306 in the process direction B. A marking material (e.g., toner) is present on the surface 332 of the medium 330. In embodiments, the fuser roll 302 is rotated counter-clockwise and the pressure roll 304 is rotated clockwise, to transport the medium 330 through the nip 306 in the process direction B. The medium 330 can be, e.g., paper, a transparency, or packaging material, and can be coated or uncoated.

The fuser 300 further includes a voltage modulator 370 connected to the heating elements 350, 352. The voltage modulator 370 controls the heating elements 350, 352 to control heating of the fuser roll 302 during warm-up, standby and print runs.

The fuser 300 includes a temperature sensor 380 for sensing a pre-nip temperature at a pre-nip location. In embodiments, the temperature sensor 380 is positioned over (e.g., proximate to (as shown), or in contact with) the outer surface 303 of the fuser roll 302 to sense the temperature of the outer surface 303 at a pre-nip location. In embodiments, pre-nip location is proximate to the inlet end of the nip 306 at which the medium 330 enters the nip 306. For example, the temperature sensor 380 can be located about 25 mm to about 50 mm from the inlet end of the nip 306, or the temperature sensor 380 can be located closer to, or further from, the inlet end of the nip 306. The temperature sensor 380 sends a temperature signal to the voltage modulator 370 to which the temperature sensor 380 is electrically connected. The temperature signal is indicative of the pre-nip temperature of the outer surface 303 of the fuser roll 302.

As shown, the fuser 300 can include an optional first external heater roll 390 and an optional second external heater roll 396 for heating the outer surface 303 of the fuser roll 302. The first external heater roll 390 includes one or more internal heating elements 392 (two are shown) and the second external heater roll 396 includes one or more internal heating elements 398 (two are shown). The heating elements 392, 398 can be axially-extending lamps, or the like. The heating elements 392 can include, e.g., one long lamp and one short lamp; and the heating elements 398 can include, e.g., one long lamp and one short lamp. The heating elements 392, 398 can have a rated power of about 2000 watts to about 2500 watts, for example.

A thermistor 394 is positioned over (e.g., proximate to (as shown) or in contact with) the first external heater roll 390, and a thermistor 399 is positioned over (e.g., proximate to (as shown) or in contact with) the outer surface of the second external heater roll 396. The thermistors 394, 399 are used in the fuser 300 to limit overheating of the respective first external heater roll 390 and second external heater roll 396. The thermistors 394, 399 are adapted to stop the supply of voltage to the respective heating elements 392, 398 when the temperature of the first external heater roll 390 and/or the second external heater roll 394 exceeds a limit temperature. When the temperature of the first external heater roll 390 and/or the second external heater roll 394 then falls to below its respective limit temperature, the supply of voltage to the heating elements 392 and/or 398 is resumed.

Figure 4:
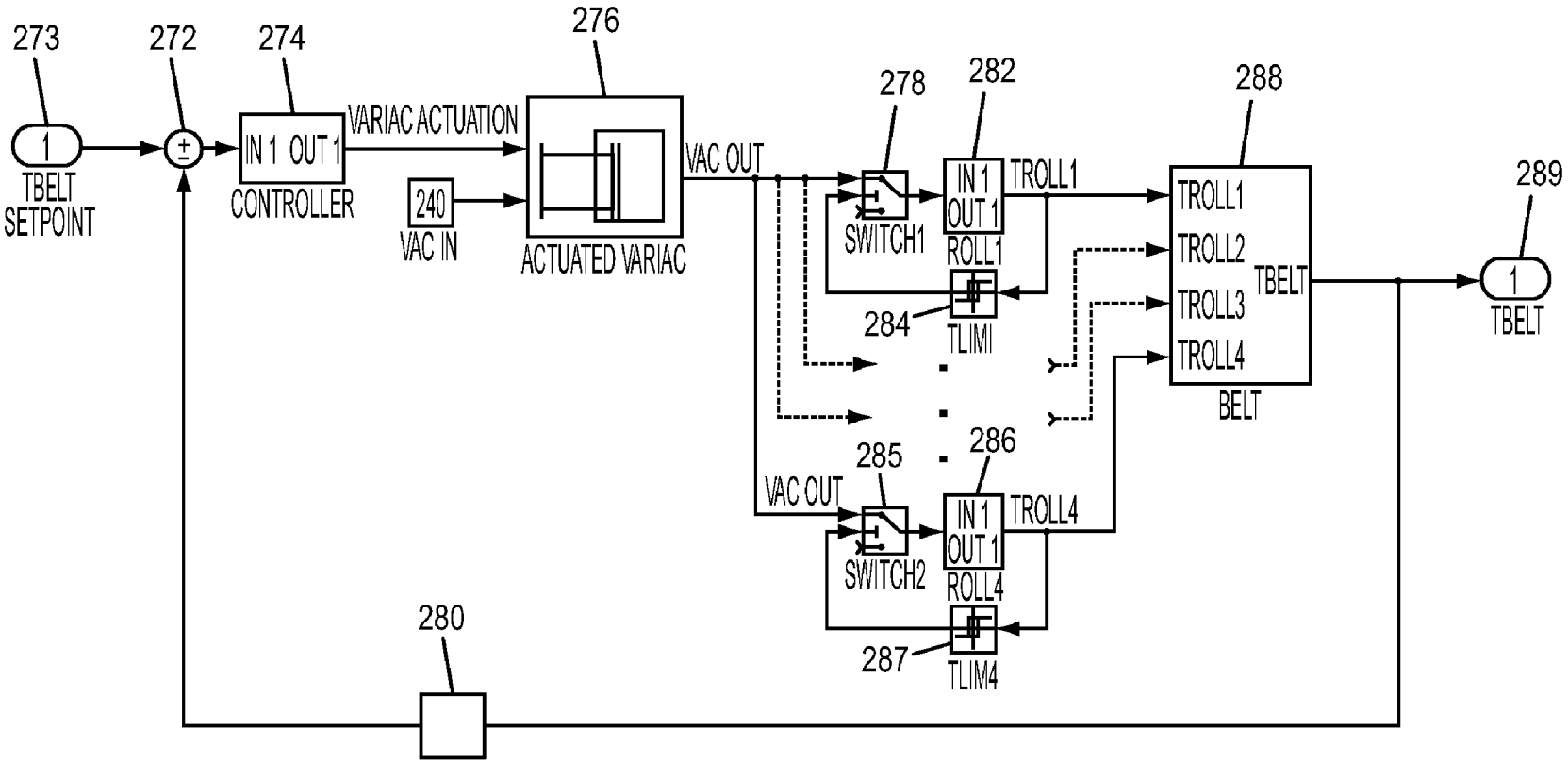
FIG. 4 illustrates an exemplary embodiment of a voltage modulator control schematic.

FIG. 4 shows an exemplary control schematic of the voltage modulator 270 shown in FIG. 2 using feedback control. As shown, at 273 a belt set-point temperature ($T_{BELT\ SETPOINT}$) and an output from the temperature sensor 280 indicative of the temperature of the belt 220 are input to a summing junction 272. The summing junction 272 is connected to a controller 274. The controller 274 is connected to a device 276 that supplies a modulated AC voltage output to each of the heating elements 250, 252, 254, 256, 258, 260, 262, 264.

In embodiments of the voltage modulator 270, the device 276 is a variable transformer. In the illustrated control schematic shown in FIG. 4, the device 276 is a VARIAC®. Embodiments of the variable transformer can be motor-driven and operable to change the output voltage from zero to full range in 5, 15, 30 or 60 seconds. These variable transformers can operate from zero to full rated AC voltage at either 50 Hz or 60 Hz, depending on their electrical design. Such variable transformers are available from Staco Energy Products Co., Dayton, Ohio. Embodiments of the variable transformers can provide full-range correction in about 1 second. Such variable transformers are available from Electronic Specialists, Inc., Natick, Mass.

The controller 274 controls the operation of the device 276 to supply a modulated AC voltage to the heating elements 250, 252, 254, 256, 258, 260, 262 and 264. In embodiments, each of the respective pairs of heating elements 250, 252; 254, 256; 258, 260; and 262, 264 can supply about the same total amount of power to the belt 220. The normal power fluctuation can range from a total of about 1500 watts to about 7000 watts, with the low power consumption corresponding to standby power and the high power consumption corresponding to the warm-up power.

The controller 274 is a control loop feedback mechanism. In embodiments, the controller 274 can be a proportional-integral-derivative (PID) controller. The temperature of the outer surface 224 of the belt 220 measured by the temperature sensor 280 is compared to the belt set-point temperature. The controller 274 corrects errors between the measured temperature and the set-point temperature for the belt 220 by calculating and outputting a corrective action to adjust operation of the device 276 to control the AC voltage supplied to the heating elements 250, 252, 254, 256, 258, 260, 262 and 264, so as to control the power level at which these heating elements are operated from partial to full power.

In embodiments, the device 276 can supply AC voltage to cause the heating elements 250, 252, 254, 256, 258, 260, 262 and 264 to remain continuously ON at either partial power or full power. As used herein, the term "continuously" means under normal operating conditions of the fuser 200 when the printing apparatus is turned ON. The heating elements 250, 252, 254, 256, 258, 260, 262 and 264 remain ON at either partial or full power when the associated fuser roll 202, external roll 208 and internal rolls 210, 212 are at a temperature below their respective limit temperatures. When at least one of the fuser roll 202, external roll 208 and internal rolls 210, 212 exceeds its limit temperature, the heating elements of the other roll(s) will remain ON. Once the one or more rolls cool down to a temperature below the respective limit temperature, the supply of power to the one or more rolls will be resumed and supplied continuously.

In embodiments, the controller 274 can be constructed and tuned to provide a desired response time for heating, a maximum temperature overshoot (i.e., a temperature limit), and a desired steady-state temperature fluctuation (i.e., temperature band at the desired temperature), for heating of the belt 220. The response time is decreased by increasing the AC voltage supplied by the device 276 to the heating elements 250, 252, 254, 256, 258, 260, 262 and 264. Once the belt 220 reaches the desired temperature (e.g., standby temperature), the AC voltage level supplied by the device 276 to the heating elements 250, 252, 254, 256, 258, 260, 262 and 264 can be decreased and supplied continuously.

In other embodiments, the AC voltage level supplied by the device 276 to the heating elements 250, 252, 254, 256, 258, 260, 262 and 264 can be increased gradually up to full power to minimize voltage and illumination flicker. This heating schedule significantly reduces the peak current with a small increment of the response time.

As shown in FIG. 4, the device 276 can operate using an AC voltage ($V_{AC\ IN}$) of 240 volts. The actuated device 276 (ACTUATED VARIAC) supplies an AC voltage ($V_{AC\ OUT}$) to the heating elements 250, 252, 254, 256, 258, 260, 262 and 264 represented also by heating roll system blocks 282, 286 in the diagram. For simplicity, only heating roll system blocks 282, 286 are shown in FIG. 4. The supplied AC voltage can range from 0 volts AC to the rated voltage of these heating elements, e.g., 200 volts AC.

Each of the thermistors 253, 257, 259, 263 is connected via a relay to a switch. At 288, $T_{ROLL1}$, $T_{ROLL2}$, $T_{ROLL3}$ AND $T_{ROLL4}$ represent the temperatures of the fuser roll 202, external roll 209 and internal rolls 210 and 212, respectively. For simplicity, FIG. 4 shows only the heating roll system block 282, relay 284 ($T_{LIM1}$) and switch 278 ($SWITCH_1$) connected to ROLL 1 (fuser roll 202), and the heating roll system block 286, relay 287 ($T_{LIM4}$) and switch 285 ($SWITCH_4$) connected to ROLL 4 (internal roll 212). When, e.g., the thermistor 263 indicates that the temperature of the internal roll 212 exceeds its limit temperature, the switch 285 is actuated to stop the supply of AC voltage to the heating elements 262, 264 (i.e., to turn these heating elements OFF) to limit overheating of the internal roll 212. Overheating may occur during a cold-start warm-up when the belt 220 temperature is raised from, e.g., about ambient temperature to an elevated temperature (such as a standby temperature or set point). When media are fed to the nip 206 of the fuser 200, the media act as a heat sink for thermal energy from the belt 220. Overheating may also happen when a print job using heavy-weight media or coated media has ended, and the belt temperature increases due to media no longer being fed to the nip 206 and absorbing heat from the belt 220. When the temperature of the internal roll 212 falls to below the limit temperature, as indicated by the thermistor 263, the switch 285 is actuated to resume the supply of power to the heating elements 262, 264 (i.e., to turn these heating elements ON).

In embodiments, while the fuser 200 is fusing images, the fuser roll 202, external roll 208 and internal rolls 210, 212 operate below their limit temperatures and their respective heating elements operate at partial or full power. This operation is achieved by constructing embodiments of the fuser 200 to operate below the temperature limit of the heated rolls while fusing at highest speed for thickest media. The heating elements of the heated rolls lamp do not turn ON/OFF during a printing job, and will remain ON at partial or full power. The fuser 200 can provide a continuous actuation-type control and minimize or eliminate flickering issues.

In embodiments, the temperature at the outer surface 224 of the belt 220, as measured by the temperature sensor 280, can be maintained approximately constant by supplying a modulated AC voltage with the device 276 controlled by the controller 274 to cause each of the pairs of heating elements 250, 252; 254, 256; 258, 260; and 262, 264 to supply about the same total amount of power to the belt 220. In embodiments, the pre-nip temperature measured by the temperature sensor 280 can be maintained approximately constant, such as within about 1° C. to about 2° C. of the desired temperature, depending on the reliability of the temperatures sensor 280.

Figure 5:
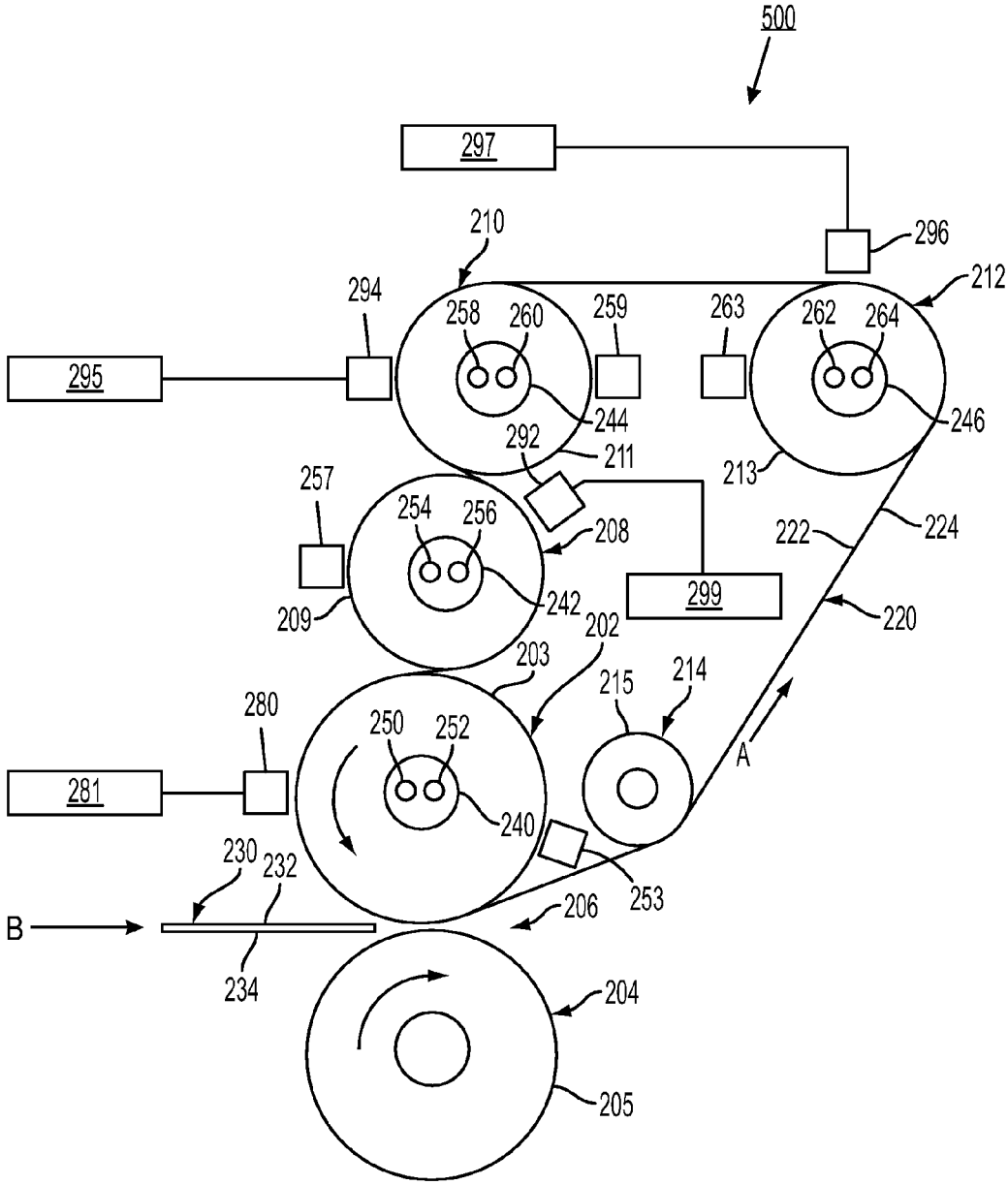
FIG. 5 illustrates an exemplary embodiment of a fuser including a belt and multiple voltage modulators.

Other embodiments of the apparatuses useful for printing can include more than one voltage modulator. FIG. 5 shows a fuser 500, which includes features of the fuser 200 shown in FIG. 2, as indicated by common reference numbers. The fuser 500 includes a first voltage modulator 281 electrically connected to a first temperature sensor 280 and the heating elements 250, 252 of the fuser roll 202; a second voltage modulator 299 electrically connected to a second temperature sensor 292 and the heating elements 254, 256 of the external roll 208; a third voltage modulator 295 electrically connected to a third temperature sensor 294 and the heating elements 258, 260 of the internal roll 210; and a fourth voltage modulator 297 electrically connected to a fourth temperature sensor 296 and the heating elements 262, 264 of the internal roll 212. In other embodiments, the fuser roll 202 does not include heating elements to heat the belt 220. The voltage modulators 281, 299, 295 and 297 individually control the operation of the heating elements of the associated rolls to thereby control heating of the belt 220 during warm-up, standby and print runs.

The first temperature sensor 280, second temperature sensor 292, third temperature sensor 294 and fourth temperature sensor 296 measure the temperature of the outer surface 224 of the belt 220 overlying the fuser roll 202, external roll 208, internal roll 210 and internal roll 212, respectively. The first temperature sensor 280, second temperature sensor 292, third temperature sensor 294 and fourth temperature sensor 296 send temperature signals to the first voltage modulator 281, second voltage modulator 299, third voltage modulator 294 and fourth voltage modulator 297, respectively. The respective voltage modulators can supply power continuously to the associated heating elements 250, 252; 254, 256; 258, 260, and 262, 264. The heating elements 250, 252; 254, 256; 258, 260, and 262, 264 can, e.g., supply different amounts of power to result in each of the fuser roll 202, external roll 208 and internal rolls 210, 212 operating at about the same temperature.

In embodiments, the first voltage modulator 281, second voltage modulator 299, third voltage modulator 295 and fourth voltage modulator 297 each include a controller and a variable transformer (such as the controller 274 and device 276 shown in FIG. 4) to provide feedback control of the heating of the respective rolls. In embodiments, a switch (not shown) is connected to each thermistor 253, 257, 259, 263. For the fuser roll 202, external roll 208 and internal rolls 210, 212, the associated thermistors 253, 257, 259, 263 and switch are actuated to stop the supply of AC voltage from the first voltage modulator 281, second voltage modulator 299, third voltage modulator 295 and fourth voltage modulator 297, respectively, to each associated heating element when the temperature of one or more of the fuser roll 202, external roll 208 and internal rolls 210, 212, respectively, exceeds its limit temperature. In embodiments in which the fuser roll does not include heating elements 250, 252, the thermistor 253 is not included in the fuser adjacent to the fuser roll 202.

Example 1

Table 1 shows numerical values calculated using a first order thermal model for a fuser having a modified configuration of the fuser 200 shown in FIG. 2. In the model, the fuser roll 202 does not include heating elements and a thermistor; each of the rolls 212, 210 and 208 includes equal-rated heated elements; the media fed to the fuser are coated and have a weight of 350 gsm; and the print speed is 165 prints/minute. The belt 220 includes an inner layer of Viton®, an intermediate layer of silicone, and an outer layer of polyamide.

As indicated in Table 1, by using belt temperature feedback control in combination with AC voltage modulation and equal-rated heating elements, each of the rolls 212, 210 and 208 supplies the same amount of power to the belt 220. The belt 220 is maintained at the temperature of 195° C. at the pre-nip location.

TABLE 1

| Roll | Roll Temperature [° C.] | Power [watts] |
|---|---|---|
| Internal Roll 212 | 196.6 | 1315 |
| Internal Roll 210 | 200.6 | 1315 |
| External Roll 208 | 202.4 | 1315 |
| Fuser Roll 202 | 195 | No heating elements |
| Total | | 3945 |

Example 2

Table 2 shows numerical values calculated using a first order thermal model for a fuser having a modified configuration as compared to the fuser 200 shown in FIG. 2. In the model, the fuser roll 202 does not include heating elements and a thermistor; a separate voltage modulator is connected to the heating elements in each of the rolls 212, 210 and 208; the heating elements in the respective rolls 212, 210 and 208 have equal-rated heating elements; the media fed to the fuser are coated and have a weight of 350 gsm; and the print speed is 165 prints/minute. The belt 220 includes an inner layer of Viton®, an intermediate layer of silicone, and an outer layer of polyamide.

As indicated by the values shown in Table 2, by using belt temperature feedback control in combination with AC voltage modulation and equal-rated heating elements, each of the rolls 212, 210 and 208 supplies the same amount of power to the belt 220 to maintain the belt 220 at the temperature of 195° C. at the pre-nip location. The total amount of power supplied by the rolls in Example 2 is about equal to the total amount of power supplied by the rolls in Example 1.

TABLE 2

| Roll | Roll Temperature [° C.] | Power [watts] |
|---|---|---|
| Internal Roll 212 | 200.9 | 1648 |
| Internal Roll 210 | 200.9 | 1239 |
| External Roll 208 | 200.9 | 1059 |
| Fuser Roll 202 | 195 | No heating elements |
| Total | | 3946 |

As demonstrated by Examples 1 and 2, by using temperature feedback control in combination with AC voltage modulation and equal-rated heating elements in the rolls, the fuser can fuse media at a more constant temperature. A smoother temperature versus time profile for the belt 220 (i.e., a more constant temperature) at the pre-nip location can be produced in the fuser 200 by maintaining the heating elements continuously ON. In addition, line voltage and illumination flicker can be reduced, and desirably minimized, during operation of apparatuses including the fuser 200.

Although the above description is directed toward fuser apparatuses used in xerographic printing, it will be understood that the teachings and claims herein can be applied to any treatment of marking material on a medium. For example, the marking material can be comprised of toner, liquid or gel ink, and/or heat- or radiation-curable ink; and/or the medium can utilize certain process conditions, such as temperature, for successful printing. The process conditions, such as heat, pressure and other conditions that are desired for the treatment of ink on media in a given embodiment may be different from the conditions suitable for xerographic fusing.

It will be appreciated that various ones of the above-disclosed, as well as other features and functions, or alternatives thereof, may be desirably combined into many other different systems or applications. Various presently unforeseen or unanticipated alternatives, modifications, variations or improvements therein may be subsequently made by those skilled in the art, and are also intended to be encompassed by the following claims.

What is claimed is:

1. An apparatus useful for printing, comprising:

a first roll including a first outer surface and at least one first heating element for heating the first outer surface;

a second roll including a second outer surface;

a nip between the first outer surface and the second outer surface;

a first temperature sensor for sensing a pre-nip temperature at a pre-nip location;

a first voltage modulator connected to each of the at least one first heating element and the first temperature sensor, wherein the first voltage modulator receives a temperature signal from the first temperature sensor indicative of the pre-nip temperature and modulates an AC voltage supplied to each first heating element to maintain each first heating element continuously ON at a power level ranging from partial power to full power to control the pre-nip temperature;

a continuous belt including an inner surface contacting the first outer surface and an outer surface contacting the second outer surface to form the nip;

wherein the pre-nip location is on the outer surface of the belt proximate to the nip;

a third roll including a third outer surface contacting the belt and at least one second heating element for heating the third outer surface;

a first thermistor disposed over the first outer surface and connected to a first switch, wherein the first thermistor and first switch are actuated to stop the supply of AC voltage from the first voltage modulator to each of the at least one first heating element when the temperature of the first roll exceeds a first limit temperature;

a second temperature sensor for sensing a temperature of the outer surface of the belt over the third outer surface;

a second voltage modulator connected to each of the at least one second heating element; and a second thermistor disposed over the third outer surface and connected to a second switch, wherein the second thermistor and second switch are actuated to stop a supply of AC voltage from the second voltage modulator to each of the at least one second heating element when the temperature of the third roll exceeds a second limit temperature;

wherein the first voltage modulator modulates the AC voltage supplied to each of the at least one first heating element to maintain each of the at least one first heating element continuously ON to control the temperature of the first outer surface when the temperature of the first roll does not exceed the first limit temperature; and wherein the second voltage modulator modulates the AC voltage supplied to each of the at least one second heating element to maintain each of the at least one second heating element continuously ON to control the temperature of the third outer surface when the temperature of the third roll does not exceed the second limit temperature;

a fourth roll including a fourth outer surface contacting the belt and at least one third heating element for heating the fourth outer surface;

a third voltage modulator connected to each of the at least one third heating element;

a third thermistor disposed over the fourth outer surface and connected to a third switch, wherein the third thermistor and third switch are actuated to stop the supply of AC voltage from the third voltage modulator to each of the at least one third heating element when the temperature of the fourth roll exceeds a third limit temperature; and a third temperature sensor for sensing a temperature of the outer surface of the belt over the fourth outer surface;

wherein the second voltage modulator controls the at least one second heating element, and the third voltage modulator controls the at least one third heating element, to cause the temperature of the outer surface of the belt over the third outer surface to approximately equal the temperature of the outer surface of the belt over the fourth outer surface.

2. The apparatus of claim 1, wherein:

the pre-nip location is on the first outer surface of the first roll proximate to the nip; and the first voltage modulator comprises:

a controller connected to the first temperature sensor; and a variable transformer connected to the controller and each first heating element;

wherein the controller receives a temperature signal from the first temperature sensor indicative of the pre-nip temperature, compares the pre-nip temperature to a set-point temperature for the first roll, and controls the variable transformer to supply the AC voltage to each first heating element to maintain each of the at least one first heating element continuously ON at a power level ranging from partial power to full power based on a difference between the pre-nip temperature and the set-point temperature.

3. A printing apparatus comprising the apparatus of claim 1, wherein the apparatus is adapted to heat and apply pressure to a marking material on a medium at the nip.

* * * * *